US008722797B2

(12) United States Patent
Stoyanov et al.

(10) Patent No.: US 8,722,797 B2
(45) Date of Patent: May 13, 2014

(54) CELLULOSE FIBERS CROSSLINKED WITH LOW MOLECULAR WEIGHT PHOSPHOROUS CONTAINING POLYACRYLIC ACID AND METHOD

(75) Inventors: Angel Stoyanov, Federal Way, WA (US); Charles E. Miller, Federal Way, WA (US)

(73) Assignee: Weyerhaeuser NR Company, Federal Way, WA (US)

( * ) Notice: Subject to any disclaimer, the term of this patent is extended or adjusted under 35 U.S.C. 154(b) by 0 days.

(21) Appl. No.: 12/569,715

(22) Filed: Sep. 29, 2009

(65) Prior Publication Data

US 2011/0077354 A1 Mar. 31, 2011

(51) Int. Cl.
*C08B 37/00* (2006.01)

(52) U.S. Cl.
USPC ..... 525/54.21

(58) Field of Classification Search
USPC ..... 525/54.21
See application file for complete search history.

(56) References Cited

U.S. PATENT DOCUMENTS

| | | | | |
|---|---|---|---|---|
| 5,256,746 | A | 10/1993 | Blankenship et al. | |
| 5,294,686 | A | 3/1994 | Fiarman et al. | |
| 5,294,687 | A | 3/1994 | Blankenship et al. | |
| 5,447,977 | A | 9/1995 | Hansen et al. | |
| 5,549,791 | A | 8/1996 | Herron et al. | |
| 5,755,828 | A * | 5/1998 | Westland | 8/185 |
| 5,998,511 | A | 12/1999 | Westland et al. | |
| 6,306,251 | B1 * | 10/2001 | Jewell et al. | 162/9 |
| 2003/0121623 | A1 | 7/2003 | Westland et al. | |
| 2005/0217810 | A1 | 10/2005 | Stoyanov | |
| 2006/0118255 | A1 | 6/2006 | Sears et al. | |
| 2009/0199349 | A1 | 8/2009 | Weinstein | |

FOREIGN PATENT DOCUMENTS

| | | | |
|---|---|---|---|
| EP | 0251675 | A | 1/1988 |
| EP | 2206523 | A1 | 7/2010 |
| WO | 9534710 | A1 | 10/1995 |
| WO | 0131124 | A1 | 5/2001 |
| WO | 02084024 | A1 | 10/2002 |

* cited by examiner

*Primary Examiner* — Yong Chu
*Assistant Examiner* — Sonya Wright
(74) *Attorney, Agent, or Firm* — Weyerhaeuser Law Dept; Timothy M. Whalen

(57) ABSTRACT

A crosslinked cellulose fiber that has been crosslinked with a low molecular weight polyacrylic acid crosslinking agent, having phosphorous incorporated into the polymer chain and a method of crosslinking the fiber.

21 Claims, No Drawings

CELLULOSE FIBERS CROSSLINKED WITH LOW MOLECULAR WEIGHT PHOSPHOROUS CONTAINING POLYACRYLIC ACID AND METHOD

The field of the present invention relates to wood pulp cellulose fibers that have been crosslinked with polyacrylic acid.

Cellulosic fibers are a basic component of absorbent products such as diapers. These fibers form a liquid absorbent structure, a key functioning element in the absorbent product. Cellulosic fluff pulp, a form of cellulosic fibers, is a preferred fiber for this application because a high void volume or high bulk, liquid absorbent fiber structure is formed. This structure, however, tends to collapse on wetting. The collapse or reduction in fiber structure bulk reduces the volume of liquid which can be retained in the wetted structure and inhibits the wicking of liquid into the unwetted portion of the cellulose fiber structure. Consequently, the potential capacity of the dry high bulk fiber structure is never realized and it is the fiber structure's wet bulk which determines the liquid holding capacity of the overall fiber structure.

Additionally, the ability of an absorbent product containing cellulosic fibers to initially acquire and distribute liquid will generally depend on the product's dry bulk and capillary structure. However, the ability of a product to acquire additional liquid on subsequent insults will depend on the product's wet bulk. Cellulosic fibers, although absorbent, tend to collapse on wetting and to retain absorbed liquid near the point of liquid insult. The inability of wetted cellulosic fibers in absorbent products to further acquire and distribute liquid to sites remote from liquid insult can be attributed to a diminished acquisition rate due in part to the loss of fiber bulk associated with liquid absorption. Absorbent products made from cellulosic fluff pulp, a form of cellulosic fibers having an extremely high void volume, lose bulk on liquid acquisition and the ability to further wick and acquire liquid, causing local saturation.

Intrafiber crosslinked cellulosic fibers and the fiber structures formed from intrafiber crosslinked cellulosic fibers generally have enhanced wet bulk compared to uncrosslinked fibers. The enhanced bulk is a consequence of the stiffness, twist, and curl imparted to the fiber as a result of crosslinking. Accordingly, crosslinked fibers are advantageously incorporated into absorbent products to enhance their wet bulk and liquid acquisition rate and to also reduce rewet.

Polycarboxylic acids have been used to crosslink cellulosic fibers. See, for example, U.S. Pat. No. 5,137,537; U.S. Pat. No. 5,183,707; and U.S. Pat. No. 5,190,563. These references describe absorbent structures containing individualized cellulosic fibers crosslinked with a C2-C9 polycarboxylic acid. Absorbent structures made from these individualized, crosslinked fibers exhibit increased dry and wet resilience and have improved responsiveness to wetting relative to structures containing uncrosslinked fibers. Furthermore, a preferred polycarboxylic crosslinking agent, citric acid, is available in large quantities at relatively low prices making it commercially competitive with formaldehyde and formaldehyde addition products.

Despite the advantages that polycarboxylic acid crosslinking agents provide, cellulosic fibers crosslinked with low molecular weight (monomeric) polycarboxylic acids such as citric acid, tend to lose their crosslinks over time and revert to uncrosslinked fibers. For example, citric acid crosslinked fibers show a considerable loss of crosslinks on storage. Such a reversion of crosslinking generally defeats the purpose of fiber crosslinking, which is to increase the fiber's bulk and capacity. Thus, the useful shelf-life of fibers crosslinked with these polycarboxylic acids is relatively short and renders the fibers somewhat limited in their utility. Polymeric polycarboxylic acid crosslinked fibers, however, exhibit a density that remains substantially unchanged over the life-time of fibrous webs prepared from these fibers. See, for example, U.S. Pat. No. 6,620,865. This resistance to aging or reversion of density relates to the formation of multiple stable intrafiber crosslinks using polymeric polycarboxylic acid crosslinking agents. In contrast, cellulose fibers crosslinked with citric acid show a considerable increase in density, accompanied by a loss of bulk and absorbent capacity over time. Generally, the increase in density indicates a decrease in the level of crosslinking (i.e., reversion) in the fibers. In addition to density increase, the loss of crosslinking in the fibrous web results in a less bulky web and, consequently, diminished absorbent capacity and liquid acquisition capability.

The reason for the difference in the reversion is that the citric acid molecule participates with two of its carboxyl groups in the crosslinking reaction, while the polyacrylic acid molecule participates with many of its carboxyl groups.

Unfortunately, citric acid or monomeric α-hydroxy polycarboxylic acid crosslinking agents can cause also discoloration (i.e., yellowing) of the white cellulosic fibers at the elevated temperatures required to effect the crosslinking reaction.

Bleaching is a common method for increasing pulp brightness of pulp. Industry practice for improving appearance of fluff pulp is to bleach the pulp to ever-higher levels of brightness (the Technical Association of the Pulp & Paper Industry ("TAPPI") or the International Organization for Standardization ("ISO")). Traditional bleaching agents include elemental chlorine, chlorine dioxide, and hypochlorites. However, bleaching is expensive, environmentally harsh, and often a source of manufacturing bottleneck. Widespread consumer preference for a brighter, whiter pulp drives manufacturers to pursue ever more aggressive bleaching strategies. While highly bleached pulps are "whiter" than their less-bleached cousins, these pulps are still yellow-white in color. A yellow-white product is undesirable. Countless studies suggest that consumers clearly favor a blue-white over a yellow-white color. The former is perceived to be whiter, i.e., "fresh", "new" and "clean", while the latter is judged to be "old", "faded", and "dirty".

In addition to fiber discoloration, unpleasant odors can also be associated with the use of α-hydroxy carboxylic acids such as citric acid. Recently, it was found that the characteristic odor associated with citric acid crosslinked cellulosic fibers could be removed and the brightness improved by contacting the fibers with an alkaline solution (e.g., an aqueous solution of sodium hydroxide) and an oxidizing bleaching agent (e.g., hydrogen peroxide). See U.S. Pat. No. 5,562,740. In the method, the alkaline solution raises the finished fiber pH preferably to the 5.5-6.5 range from about 4.5. This, in combination with the oxidizing bleaching agent, eliminates the "smokey and burnt" odor characteristics of the citric acid crosslinked fibers. The oxidizing bleaching agent also helps to increase final product brightness.

Accordingly, there exists a need for crosslinked cellulosic fibers having advantageous bulk and improved brightness and whiteness. The present invention seeks to fulfill these needs and provides further related advantages.

The polyacrylic acid crosslinking agent of the present invention is a polyacrylic acid, having phosphorous incorporated into the polymer chain (as a phosphinate) by introduction of sodium hypophosphite during the polymerization process, with a molecular weight in the range of 500 to 3000 and Brookfield viscosity less than 200 cP. Two polyacrylic acid crosslinking agents that are within this definition are the Rohm & Haas products: Aquaset 1676 (QRXP 1676) and QRXP 1708. In one embodiment (type 1676), the polyacrylic acid crosslinking agent has a molecular weight in the range of 2300 to 2700 and Brookfield viscosity less than 200 cP. In another embodiment (type 1708), the polyacrylic acid crosslinking agent has a molecular weight in the range of 1000 to 1400 and a Brookfield viscosity less than 100 cP. As an example of prior art, the viscosity of Acumer 9932 (type 9932) is 320 cP and the molecular weight is 4000.

Polyacrylic acid crosslinked cellulosic fibers can be prepared by applying polyacrylic acid to the cellulosic fibers in an amount sufficient to effect intrafiber crosslinking. The amount applied to the cellulosic fibers can be from about 1 to about 10 percent by weight based on the total weight of fibers. In one embodiment, crosslinking agent in an amount from about 4 to about 6 percent by weight based on the total weight of dry fibers.

Although not necessary, polyacrylic acid crosslinked cellulosic fibers of the current invention can be prepared using a crosslinking catalyst. Suitable catalysts can include acidic salts, such as ammonium chloride, ammonium sulfate, aluminum chloride, magnesium chloride, magnesium nitrate, and more preferably alkali metal salts of phosphorous-containing acids, like phosphoric, polyphosphoric, phosphorous and hypophosphorous acids. In one embodiment, the crosslinking catalyst is sodium hypophosphite. The amount of catalyst used can vary from about 0.1 to about 5 percent by weight based on the total weight of dry fibers.

Cellulosic fibers useful for making the bleached polyacrylic acid crosslinked cellulosic fibers of the invention are derived primarily from wood pulp. Suitable wood pulp fibers for use with the invention can be obtained from well-known chemical processes such as the kraft and sulfite processes, with or without subsequent bleaching. The pulp fibers may also be processed by thermomechanical, chemithermomechanical methods, or combinations thereof. The preferred pulp fiber is produced by chemical methods. Ground wood fibers, recycled or secondary wood pulp fibers, and bleached and unbleached wood pulp fibers can be used. A preferred starting material is prepared from long-fiber coniferous wood species, such as southern pine, Douglas fir, spruce, and hemlock. Details of the production of wood pulp fibers are well-known to those skilled in the art. Suitable fibers are commercially available from a number of companies, including the Weyerhaeuser Company. For example, suitable cellulose fibers produced from southern pine that are usable in making the present invention are available from the Weyerhaeuser Company under the designations $CF_{416}$, $CF_{405}$, NF405, NB416, FR416, FR516, PW416 and PW405.

Polyacrylic acid crosslinked cellulose fibers useful in making the present invention may be prepared by a system and apparatus as described below. Briefly, the fibers are prepared by a system and apparatus that includes a conveying device for transporting a mat or web of cellulose fibers through a fiber treatment zone; an applicator for applying a treatment substance from a source to the fibers at the fiber treatment zone; a fiberizer for separating the individual cellulose fibers comprising the mat to form a fiber output comprised of substantially unbroken and essentially singulated cellulose fibers; a dryer coupled to the fiberizer for flash evaporating residual moisture; and a controlled temperature zone for additional heating of fibers and an oven for curing the crosslinking agent, to form dried and cured individualized crosslinked fibers.

As used herein, the term "mat" refers to any nonwoven sheet structure comprising cellulose fibers or other fibers that are not covalently bound together. The fibers include fibers obtained from wood pulp or other sources including cotton rag, hemp, grasses, cane, cornstalks, cornhusks, or other suitable sources of cellulose fibers that may be laid into a sheet. The mat of cellulose fibers is preferably in an extended sheet form, and may be one of a number of baled sheets of discrete size or may be a continuous roll.

Each mat of cellulose fibers is transported by a conveying device, for example, a conveyor belt or a series of driven rollers. The conveying device carries the mats through the fiber treatment zone.

At the fiber treatment zone, a crosslinking agent solution is applied to the mat of cellulose fibers. The crosslinking agent solution is preferably applied to one or both surfaces of the mat using any one of a variety of methods known in the art, including spraying, rolling, or dipping. Once the crosslinking agent solution has been applied to the mat, the solution may be uniformly distributed through the mat, for example, by passing the mat through a pair of rollers.

After the mat's fibers have been treated with the crosslinking agent, the impregnated mat is fiberized by feeding the mat through a hammermill. The hammermill serves to disintegrate the mat into its component individual cellulose fibers, which are then air conveyed through a drying unit to remove the residual moisture. In a preferred embodiment, the fibrous mat is wet fiberized.

The resulting treated pulp is then air conveyed through an additional heating zone (e.g., a dryer) to bring the temperature of the pulp to the cure temperature. In one embodiment, the dryer comprises a first drying zone for receiving the fibers and for removing residual moisture from the fibers via a flash-drying method, and a second heating zone for curing the crosslinking agent. Alternatively, in another embodiment, the treated fibers are blown through a flash-dryer to remove residual moisture, heated to a curing temperature, and then transferred to an oven where the treated fibers are subsequently cured. Overall, the treated fibers are dried and then cured for a sufficient time and at a sufficient temperature to effect crosslinking. Typically, the fibers are oven-dried and cured for about 1 to about 20 minutes at a temperature from about 120° C. to about 200° C.

The fibers made according to the present invention have unique combinations of stiffness and resiliency, which allow absorbent structures made from the fibers to maintain high levels of absorptivity, and exhibit high levels of resiliency and an expansionary responsiveness to wetting of a dry, compressed absorbent structure.

The fibers crosslinked with the polyacrylic crosslinking agents having phosphinates in the polymer chain and having molecular weights below 3000 provide crosslinked fibers having higher wet bulk, lower 5K density, higher ISO brightness, and lower Hunter b, than polyacrylic acid crosslinking agents that do not have phosphinates in the polymer chain or polyacrylic acid crosslinking agents having phosphinates in the polymer chain and having higher molecular weights.

Wet Bulk

Method for determining fiber wet bulk. The wet bulk of crosslinked cellulosic fibers crosslinked was determined by the Fiber Absorption Quality (FAQ) Analyzer (Weyerhaeuser Co. Federal Way, Wash.) using the following procedure.

In the procedure, a 4-gram sample of the pulp is put through a pinmill to open the pulp and then airlaid into a tube. The tube is then placed in the FAQ Analyzer. A plunger then descends on the fluff pad at a pressure of 0.6 kPa and the pad height measured and the pad bulk determined from the pad height.

The weight is increased to achieve a pressure of 2.5 kPa and the bulk recalculated. The result is two bulk measurements on the dry fluff pulp at two different pressures. While under the 2.5 kPa pressure, water is introduced into the bottom of the tube (bottom of the pad). The time required for water to reach the plunger is measured. From this the absorption time and rate are determined. The final bulk of the wet pad at 2.5 kPa is also calculated. The plunger is then withdrawn from the tube and the wet pad allowed to expand for 60 seconds. The plunger is reapplied at 0.6 kPa and the bulk determined. The final bulk of the wet pad at 0.6 kPa is considered the wet bulk ($cm^3/g$) of the pulp product.

The 5K Density Test

The 5K density test herein is a measure of fiber stiffness and of dry resiliency of a structure made from the fibers (i.e., ability of the structure to expand upon release of compressional force applied while the fibers are in substantially dry condition) and is carried out according to the following procedure:

A four inch by four inch square air laid pad having a mass of about 7.5 g is prepared from the fibers for which dry resiliency is being determined, and compressed, in a dry state, by a hydraulic press to a pressure of 5000 psi, and the pressure is quickly released. The pad is inverted and the pressing is repeated and released. The thickness of the pad is measured after pressing (Ames thickness tester). Five thickness readings are taken, one in the center and 0.001 inches in from each of the four corners and the five values are averaged. The pad is trimmed to 10.2 cm by 10.2 cm (4 inches by 4 inches) and then is weighed. Density after pressing is then calculated as mass/(area×thickness). This density is denoted the 5K density herein. The lower the values in the 5K density test, i.e., the density after pressing, the greater the fiber stiffness and the greater the dry resiliency are.

Whiteness and Brightness

*Webster's Dictionary* defines white as "the object color of greatest lightness characteristically perceived to belong to objects that reflect diffusely nearly all incident energy throughout the visible spectrum". Used as a noun or adjective, white is defined as "free from color". Most natural and many man-made products are never "free from color". Whether the "white" product is fluff pulp, paper, textiles, plastics, or teeth, there is almost always an intrinsic color, other than white, associated with it. Consider two hypothetical objects. The first meets Webster's definition of white: one characterized by a flat spectrum of high reflectance and a second, which is the first with a small amount of blue colorant added (resulting in an unequal spectrum). Most people will judge the second to be whiter, even though its total reflectance is lower in certain spectral regions. The first will be judged as a "yellow-white" while the second a "blue-white". Further, with the subjectivity of human color vision certain associations are unconsciously made. Blue-white is associated with "clean and pure", while "yellow-white" denotes "dirty, old or impure". Consequently, the types and amounts of fillers and colorants, which hues are appropriate (e.g., red-blue, green-blue), and the optimal optical prescription to target have been the subject of considerable interest.

Whiteness attribute, not TAPPI brightness, better correlates with customer preference for product whiteness. When people are given a choice between two products having equal TAPPI brightness, usually the product exhibiting the higher whiteness attribute is preferred. The application of CIE Whiteness is but one measure of such a whiteness attribute. Similarly, a product having higher whiteness than the product to which it is being compared is preferred even when the former exhibits a lower brightness. TAPPI Brightness in North America and ISO Brightness (ISO BRT) throughout the rest of the world, are pulp and paper industry-specific standards used to loosely quantify the "whiteness" of a product. Regardless of which standard is applied, TAPPI or ISO, brightness is defined as the percent reflectance of product measured at an effective wavelength of 457 nm. In general, higher brightness is perceived by the industry to imply higher whiteness, but this is not always the case. Because brightness is a band-limited measurement taken in the blue end of the visible spectrum, it essentially measures how blue a product is. If a brightness specification is relied on, it is possible to maximize TAPPI brightness, yet produce a product that appears blue, not white. Brightness provides little indication of how white a product is nor does it tell anything about its lightness, hue, or saturation. As a whiteness specification, it is insufficient. Such is the danger of pursuing brightness when whiteness is the principal objective.

Hunter L, a and b values are used to designate measured values of three attributes of surface-color appearance as follows: L represents lightness, increasing from zero for black to 100 for perfect white; a represents redness when positive, greenness when negative, and zero for gray; and b represents yellowness when positive, blueness when negative, and zero for gray. The concept of opponent colors was proposed by Hering in 1878. Since the 1940s, a number of measurable L, a, b dimensions have been defined by equations relating them to the basic CIE XYZ tristimulus quantities defined in CIE Document No. 15. Measured values for a given color will depend on color space in which they are expressed [(TAPPI T 1213 sp-98 "Optical measurements terminology (related to appearance evaluation of paper")].

Basic color measurement is made using commercially available instruments (e.g., Technibrite MicroTB-1C, Technydine Corp.). The instrument scans through the brightness and color filters. Fifty readings are taken at each filter position and averaged. The measurements are reported as Brightness, R(X), R(Y), and R(Z). Brightness is ISO brightness (457 nm), R(X) is absolute red reflectance (595 nm), R(Y) is absolute green reflectance (557 nm), and R(Z) is absolute blue reflectance (455 nm). The CIE tristimulus functions X, Y, and Z are then computed in accordance with the following equations: $X=0.782\ R(X)+0.198\ R(Z)$, $Y=R(Y)$, and $Z=1.181\ R(Z)$. Next L, a and b values are computed using the established equations (Technibrite Micro TB-1C Instruction Manual TTM 575-08, Oct. 30, 1989). Whiteness Index, $WI_{(CDM-L)}$, was calculated in accordance with the equation, $WI_{(CDM-L)}=L-3b$, according to TAPPI T 1216 sp-98 (TAPPI T 1216 sp-98 "Indices for whiteness, yellowness, brightness and luminous reflectance factor").

Web Penetration Test

This method is used to measure the time for cross linking chemistry at the appropriate concentration to fully penetrate the pulp sheet. The operating principle is similar to a Hercules Size Tester (Tappi T530 om-02). A minimum 1" diameter pulp sheet sample or 1" strip is placed over an aperture. Light from a bright white LED is directed through the aperture to the bottom of the pulp sheet. Using a photocell, reflectance of the bottom side of the pulp sheet is continuously measured using a data acquisition system (for example Dataq Instruments DI-700 hardware and Windaq software). The sample liquid (0.75 mL) is added to a ½" diameter well placed on top of the pulp sheet (e.g. via an automatic pipette). The initial time is noted when the liquid is added and the reflectance is monitored. The time is measured for the sample to wick through the entire thickness of the pulp sheet from top to bottom.

In the examples, the following nonphosphinated polyacrylic acid crosslinking agents were used: an Alco product: Aquatreat AR900A (Type 900) having a molecular weight of 2600; a Rohm & Haas product: Acumer 1020 (Type 1020) having a molecular weight of 2000; BASF products: Sokalan PA 15 (Type 15) having a molecular weight of 1200, Sokalan PA 20PN (Type 20) having a molecular weight of 2500, Sokalan PA 25 CL PN (Type 25) having a molecular weight of 4000 and Sokalan PA 30 CL PN (Type 30) having a molecular weight of 8000. The following Rohm & Haas phosphinated polyacrylic acid crosslinking agents having dialkyl phosphinates in the polymer chain were also used: Aquaset 1676 (QRXP 1676) (also called Type 1676), having a molecular weight of 2500; Acumer 9932 (Type 9932) having a molecular weight of 4000; and QRXP 1708 (Type 1708) having a molecular weight of 1200. Another Rohm & Haas crosslinking agent with a molecular weight between 1200 and 2500 (Type 1700) was also tested.

In the following examples, the southern pine kraft pulp fibers were treated with the polyacrylic acid crosslinking agent. The amount of crosslinking agent on the pulp sheet by weight (% COP) is specified. In some examples, the fibers were also treated with a catalyst, sodium hypophosphite (SHP), and the amount by weight (% COP) is specified in Tables. The fibers were cured at the cure temperature of the period of time specified (cure time). In some cases the fibers were bleached with hydrogen peroxide and sodium hydroxide, or just with hydrogen peroxide. The amount of chemical per air dry metric ton (ADMT) is specified. The fiber characteristics were measured by the tests noted above.

From the examples, it can be seen that the polyacrylic acid crosslinking agent having a dialkyl phosphinate in the polymer chain and having a molecular weight below 3000 provides better brightness, better whiteness index, better wet bulk and better 5K density than the higher molecular weight polyacrylic acid crosslinking agents having dialkyl phosphinates in the polymer chain and far better than those polyacrylic acid crosslinking agents that do not have dialkyl phosphinates in the polymer chain.

In Table 1, two pulps were crosslinked with Aquaset 1676 having a molecular weight of 2500. The crosslinked fibers have a higher wet bulk, a lower 5K density, a higher ISO brightness and a lower Hunter b than pulps treated with Acumer 9932 having a molecular weight of 4000. No catalyst is used. This also holds true to a great extent when a catalyst is used but the differences are smaller.

In Table 2, The AFAQ bulk at 0.6 kPa and 5K densities for a number of polyacrylic acid crosslinking agents were compared. The wet bulk of the Aquaset 1676 treated fibers (without catalyst) is markedly higher than the other crosslinking agents, including the Acumer 9932, and the 5K density of the Aquaset 1676 is markedly lower (better) than the other crosslinking agents, including the Acumer 9932. Again the application and curing of the crosslinking agent was as described above. There was 5% by weight crosslinking agent on the pulp. No catalyst was used for the Aquaset and Acumer crosslinking agents. The other crosslinking agents had 0.175% by weight SHP on the pulp. The Aquaset and Acumer crosslinking agents were cured at 380° F. for 5 minutes. The other crosslinking agents were cured at 370° F. for 7 minutes. The AFAQ wet bulk densities in cubic centimeters/gram (cc/g) were 17.89 for Aquaset 1676, 16.89 for Acumer 9932, 16.02 for Sokalan PA 30 CL PN, 15.76 for Sokalan PA 25 CL PN, 15.72 for Sokalan PA 20 PN and 14.41 for Sokalan PA 15. The 5K density in grams/cubic centimeters (g/cc) was 0.124 for Aquaset 1676, 0.145 for Acumer 9932, 0.181 for Sokalan PA 30 CL PN, 0.193 for Sokalan PA 25 CL PN, 0.218 for Sokalan PA 20 PN and 0.266 for Sokalan PA 15.

TABLE 1

| | | Crosslinking agent | | | SHP | Cure Temp | Cure time | AFAQ Wet Bulk | 5K Density | ISO BRT | Hunter b value |
|---|---|---|---|---|---|---|---|---|---|---|---|
| Ex. | Pulp | Type | MW | % COP | % COP | ° F. | min. | cc/g | g/cc | % | — |
| 1 | NF405 | 9932 | 4000 | 5 | — | 380 | 5 | 16.97 | 0.124 | 79.3 | 8.37 |
| 2 | NF405 | 1676 | 2500 | 5 | — | 380 | 5 | 17.87 | 0.113 | 79.8 | 8.26 |
| 3 | NF405 | 9932 | 4000 | 5 | 0.625 | 380 | 5 | 17.82 | 0.119 | 80.4 | 8.11 |
| 3 | NF405 | 1676 | 2500 | 5 | 0.625 | 380 | 5 | 17.76 | 0.111 | 80.9 | 7.82 |
| 5 | CF405 | 9932 | 4000 | 5 | — | 380 | 5 | 16.89 | 0.145 | 80.1 | 7.88 |
| 6 | CF405 | 1676 | 2500 | 5 | — | 380 | 5 | 17.89 | 0.124 | 80.6 | 7.64 |
| 7 | CF405 | 9932 | 4000 | 5 | 0.625 | 380 | 5 | 17.61 | 0.128 | 80.9 | 7.46 |
| 8 | CF405 | 1676 | 2500 | 5 | 0.625 | 380 | 5 | 17.94 | 0.117 | 80.8 | 7.48 |

TABLE 2

| | | Crosslinking agent | | | SHP | Cure Temp | Cure time | AFAQ Wet bulk | 5K Density | ISO BRT | $WI_{(CDM-L}$ |
|---|---|---|---|---|---|---|---|---|---|---|---|
| Ex | Pulp | Type | MW | % COP | % COP | ° F. | min | cc/g | g/cc | % | — |
| 9 | CF416 | 15 | 1200 | 5 | 0.175 | 370 | 7 | 14.41 | 0.266 | 77.6 | 68.9 |
| 10 | CF416 | 20 | 2500 | 5 | 0.175 | 370 | 7 | 15.72 | 0.218 | 75.2 | 66.6 |
| 11 | CF416 | 1676 | 2500 | 5 | — | 380 | 5 | 17.89 | 0.124 | 78.6 | 71.2 |
| 12 | CF416 | 25 | 4000 | 5 | 0.175 | 370 | 7 | 15.78 | 0.193 | 75.5 | 66.7 |
| 13 | CF416 | 9932 | 4000 | 5 | — | 380 | 5 | 16.89 | 0.146 | — | — |
| 14 | CF416 | 30 | 8000 | 5 | 0.175 | 370 | 7 | 16.02 | 0.181 | 73.9 | 63.1 |

TABLE 3

| Ex | Pulp | Crosslinking agent Type | MW | % COP | SHP % COP | Cure Temp ° F. | Cure time min. | 5K Density g/cc | ISO BRT % | Hunter b — |
|---|---|---|---|---|---|---|---|---|---|---|
| 15 | CF416 | 1676 | 2500 | 6 | 0.210 | 380 | 5 | 0.153 | 82.7 | 6.85 |
| 16 | CF416 | 1708 | 1200 | 6 | 0.210 | 380 | 5 | 0.142 | 81.9 | 7.36 |
| 17 | CF416 | 1676 | 2500 | 9 | 0.315 | 380 | 5 | 0.134 | 81.5 | 7.32 |
| 18 | CF416 | 1708 | 1200 | 9 | 0.315 | 380 | 5 | 0.117 | 81.0 | 7.99 |

TABLE 4

| Ex | Pulp | Crosslinking agent Type | MW | % COP | Cure temp ° F. | Cure time min | ISO BRT % | Whiteness Index — | Hunter b — |
|---|---|---|---|---|---|---|---|---|---|
| 19 | NF 405 | 1676 | 2500 | 8 | 350 | 7 | 83.5 | 74.89 | 6.97 |
| 20 | NF 405 | 1020 | 2000 | 8 | 356 | 7 | 77.3 | 67.17 | 9.03 |
| 21 | NF 405 | 900 | 2600 | 8 | 356 | 7 | 79 | 69.58 | 8.39 |

TABLE 5

| Ex. | Pulp | Crosslinking agent Type | MW | % COP | SHP % COP | Cure Temp ° F. | Cure time min. | Post-bleaching $H_2O_2$ #/ADMT | NaOH #/ADMT | AFAQ Wet Bulk cc/g | 5K Density g/cc | ISO BRT 0 days % | ISO BRT 1 day % | Hunter b 0 days — | Hunter b 1 day — |
|---|---|---|---|---|---|---|---|---|---|---|---|---|---|---|---|
| 22 | CF416 | 1676 | 2500 | 5.34 | — | 380 | 8 | — | — | 18.8 | 0.128 | 75.3 | 77.0 | 9.37 | 8.57 |
| 23 | CF416 | 1676 | 2500 | 5.34 | — | 380 | 8 | 5 | — | 18.5 | 0.132 | 77.1 | 83.5 | 8.62 | 5.61 |
| 24 | CF416 | 1676 | 2500 | 5.34 | — | 380 | 8 | 5 | 2.5 | 18.6 | 0.133 | 79.7 | 84.0 | 7.51 | 5.29 |
| 25 | CF416 | 1676 | 2500 | 5.34 | — | 360 | 8 | — | — | 17.3 | 0.162 | 80.3 | 80.2 | 7.20 | 7.33 |
| 26 | CF416 | 1676 | 2500 | 5.34 | — | 360 | 8 | 5 | — | 17.6 | 0.157 | 80.8 | 81.7 | 7.05 | 6.87 |
| 27 | CF416 | 1676 | 2500 | 5.34 | — | 360 | 8 | 5 | 2.5 | — | 0.169 | 81.7 | 82.9 | 6.68 | 5.99 |

This demonstrates that the placement of the phosphorus within the polymer chain and a low molecular weight provide better crosslinking and better properties.

It can be appreciated that the dialkyl phosphinates provide an autocatalytic effect allowing the use of lower molecular weight polymers as there are more phosphinates available to initiate the cross linking reaction. The Sokalan samples (Type, 15, 20, 25 and 30) with the required catalyst show improved 5K density (a reduction in value) with increasing the molecular weight. The observation is the opposite for phosphinated crosslinking agents. The molecular weight was then reduced further to confirm the autocatalytic effect. Type 1708 (molecular weight ~1200) has a 5K density of 0.142 g/cc which is better than type 1676 (0.153 g/cc), under the conditions described in Table 3, at level of application 6% COP. The same tendency is confirmed at level of application 9% COP: 0.117 (for Type 1708) vs. 0.134 (for Type 1676).

The penetration times of Type 1676 was compared to the penetration times of Type 1708 and Type 1700 (intermediate molecular weight as noted above) at two application levels, 7% and 9% crosslinking agent on pulp. At 7% the penetration time was 1.37 seconds for Type 1676, 1.12 seconds for Type 1700 and 0.76 seconds for Type 1708. At 9% the penetration time was 2.22 seconds for Type 1676, 1.30 seconds for Type 1700 and 0.92 seconds for Type 1708.

The viscosities of some of the PAA crosslinking agents were determined. At 7% crosslinking agent on pulp, QRXP 1676 had Brookfield viscosity of 13.11 cP, Type 1700 had Brookfield viscosity of 10.67 cP, and Type 1708 had Brookfield viscosity of 10.29 cP. At 9% crosslinking agent on pulp, QRXP 1676 had Brookfield viscosity of 14.60 cP, Type 1700 had Brookfield viscosity of 11.39 cP, and type 1708 had Brookfield viscosity of 10.93 cP.

Lower viscosities allow better penetration of the pulp sheet. The penetration of the pulp sheet is faster with lower viscosity crosslinking agents. There is a finite time for the crosslinking agent to be on the pulp sheet so faster penetration of the sheet means that more of the pulp sheet will be treated with the crosslinking agent and more of the fibers will be crosslinked in the curing operation. Those fibers that are not treated with the crosslinking agent will not be crosslinked. Thus a faster penetration time means more uniform crosslinking of the fibers. A lower viscosity means a faster penetration and more fibers being crosslinked. Penetration times of less than 3 seconds, of less than 2 seconds and of less than 1 second can be achieved.

Earlier it was indicated that phosphinated crosslinking agents of the current invention also provide improved color and whiteness. The Whiteness Index of Aquaset 1676 was compared to the BASF Sokalan products (See Table 2). The Whiteness Index of the Aquaset treated pulp was 71.22. The Whiteness Index of the Sokalan PA 20 PN treated pulp was 66.64, while the one treated with Sokalan PA 30 CL PN was 63.1.

In Table 4, the Whiteness Index of Aquaset 1676 was compared to Acumer 1020 (Type 1020) and Aquatreat AR900A (Type 900). The crosslinking agents were applied at 8% by weight on the pulp. No catalyst was used. The Aquaset treated pulp was cured at 350° F. for 7 minutes. The Acumer and Aquatreat treated pulps was cured at 356° F. for 7 minutes. The Whiteness Index of the Aquaset treated pulp was 74.99. The Whiteness Index of the Acumer treated pulp was 67.17. The Whiteness Index of the Aquatreat (Type 900) treated pulp was 69.59.

In yet another example, the ISO brightness in % of a pulp treated with a polyacrylic acid crosslinking agent having phosphorous in the chain (Type 1676) was compared with two pulps crosslinked with a polyacrylic acid crosslinking agent that did not have phosphorous in the chain, one being terminated with a phosphite ($PO_3$-terminated) and one being terminated with IPA (IPA-terminated). The crosslinking agents were applied at 5% by weight of crosslinking agent on the pulp. One set was cured at 350° F. for 7 minutes. The ISO brightness values were 80.4% for the phosphorous containing polyacrylic acid crosslinking agent, 71.9% for the phosphite terminated control and 69.3 for the IPA terminated control. The corresponding Whiteness Indices were 74.2 (for Type 1676), 65.8 (for $PO_3$-terminated) and 58.7 (for IPA-terminated). Another set was cured at 370° F. for 7 minutes. The ISO brightness values were 75.9% for the phosphorous containing polyacrylic acid crosslinking agent, 69.1% for the phosphite terminated control and 64.1 for the IPA terminated control. The corresponding Whiteness Indices were 67 (for Type 1676), 61.1 (for $PO_3$-terminated) and 51 (for IPA-terminated).

In Table 5 are compared samples crosslinked with 5.34% COP Type 1676 (no catalyst) and samples bleached with hydrogen peroxide and sodium hydroxide, as well as with only hydrogen peroxide during the post-treatment moisturization stage. Two sets of samples were prepared. One set of samples was cured at 380° F. for 8 min. and the second set—at 360° F. for 8 min. Both cases show enhanced Brightness (higher values) and color characteristics (lower Hunter b values) when additionally bleached.

The polyacrylic acid crosslinked cellulosic fibers of the invention can be advantageously incorporated into a variety of products, including, for example, paper boards, tissues, towels, and wipes, and personal care absorbent products, such as infant diapers, incontinence products, and feminine care products. Thus, in another aspect, the invention provides absorbent products including wipes, towels, and tissues as well as infant diapers, adult incontinence products, and feminine hygiene products that include bleached polyacrylic acid crosslinked cellulosic fibers.

While the preferred embodiment of the invention has been illustrated and described, it will be appreciated that various changes can be made therein without departing from the spirit and scope of the invention.

The invention claimed is:

1. Individualized, crosslinked cellulosic fibers, said fibers having between about 1.0 weight % and about 10.0 weight % of a polyacrylic acid crosslinking agent, calculated on a dry fiber weight basis, the crosslinks of said fibers being in an intrafiber crosslink ester bond form, said polyacrylic acid crosslinking agent comprising dialkyl phosphinate, and said polyacrylic acid crosslinking agent having a molecular weight from about 500 to about 3,000.

2. The fibers of claim 1, said crosslinking agent having a molecular weight in the range of 2300 to 2700 and a Brookfield viscosity less than 200 cP.

3. The fibers of claim 1, said crosslinking agent having a molecular weight in the range of 1000 to 1400 and a Brookfield viscosity less than 100 cP.

4. The fibers of claim 1, wherein a catalyst selected from alkali metal salts of phosphorous-containing acids is present in the amount of about 0.1 to about 5 weight percent.

5. The fibers of claim 4, wherein the catalyst is sodium hypophosphite.

6. The fibers of claim 1, wherein the fibers are additionally bleached with a formulation, containing hydrogen peroxide, from 0.1 up to 5 pounds per air dry metric ton ("#/ADMT"), and sodium hydroxide, from 0.1 up to 5#/ADMT.

7. The fibers of claim 1, wherein the fibers are additionally bleached with only hydrogen peroxide, from 0.1 up to 5 pounds per air dry metric ton ("#/ADMT").

8. A method for forming individualized, chemically intrafiber crosslinked cellulosic fibers comprising the steps of:

applying a polyacrylic acid crosslinking agent to a mat of cellulosic fibers, the polyacrylic acid crosslinking agent comprising dialkyl phosphinate and having a molecular weight from about 500 to about 3000;

separating the mat into substantially unbroken individualized fibers; and curing the crosslinking agent to form individualized, polyacrylic acid crosslinked cellulosic fibers.

9. The method of claim 8, said crosslinking agent having a molecular weight in the range of 2300 to 2700 and a Brookfield viscosity less than 200 cP.

10. The method of claim 8, said crosslinking agent having a molecular weight in the range of 1000 to 1400 and a Brookfield viscosity less than 100 cP.

11. The method of claim 8, wherein a catalyst is used with the crosslinking agent.

12. The method of claim 11, wherein the catalyst is selected from alkali metal salts of phosphorous-containing acids.

13. The method of claim 11, wherein the catalyst is sodium hypophosphite.

14. The method of claim 10, wherein the web penetration time is less than 3 seconds.

15. The method of claim 10, wherein the web penetration time is less than 2.5 seconds.

16. The method of claim 9, wherein the web penetration time is less than 3 seconds.

17. The method of claim 9, wherein the web penetration time is less than 2.5 seconds.

18. The method of claim 8, wherein the crosslinked cellulosic fibers are additionally bleached with a formulation, containing hydrogen peroxide, from 0.1 up to 5 pounds per air dry metric ton ("#/ADMT"), and sodium hydroxide, from 0.1 up to 5 #/ADMT, during a post-treatment moisturization stage.

19. The method of claim 8, wherein the crosslinked cellulosic fibers are additionally bleached with only hydrogen peroxide, from 0.1 up to pounds per air dry metric ton ("#/ADMT"), during a post-treatment moisturization stage.

20. The method of claim 8, wherein the temperature of the drying and/or curing process is in the range of 350 to 390° F.

21. The method of claim 8, wherein no catalyst is used with the crosslinking agent.

* * * * *